US005465865A

United States Patent [19]

Coombes

[11] Patent Number: 5,465,865

[45] Date of Patent: Nov. 14, 1995

[54] STACKABLE BULK TRANSPORT CONTAINER

[76] Inventor: Ian R. Coombes, 47 Longhurst Terrace, Christchurch, New Zealand

[21] Appl. No.: 316,209

[22] Filed: Sep. 30, 1994

Related U.S. Application Data

[63] Continuation-in-part of Ser. No. 110,534, Aug. 24, 1993, abandoned.

[51] Int. Cl.[6] ..... B65D 21/02

[52] U.S. Cl. ..... 220/410; 220/601; 220/671; 206/509

[58] Field of Search ..... 206/509, 386; 220/410, 403, 408, 601, 671–675

[56] References Cited

U.S. PATENT DOCUMENTS

| | | | |
|---|---|---|---|
| 3,406,855 | 10/1968 | McKechnie | 206/509 |
| 3,782,602 | 1/1974 | Page | 206/509 |
| 4,421,253 | 12/1983 | Croley | 220/410 |
| 4,595,112 | 6/1986 | DuBois et al. | 220/410 |
| 4,982,867 | 1/1991 | DuBois et al. | 220/403 |
| 5,024,346 | 6/1991 | Roser | 220/410 |
| 5,232,120 | 8/1993 | Dunken et al. | 206/509 |
| 5,259,509 | 11/1993 | Boal, Jr. et al. | 206/509 |

*Primary Examiner*—Joseph M. Moy
*Attorney, Agent, or Firm*—Ross, Ross & Flavin

[57] ABSTRACT

A stackable composite container consists of a cylindrical inner container having walls of a thickness capable of fully supporting the pressures of any contained liquid and an outer container enclosing the inner container and being of rectangular cross-section and of a strength adequate for withstanding stacking pressures but inadequate for withstanding the pressures of the contained liquid in the absence of the inner container. The outer container is provided with a plurality of spaced inwardly projecting ribs in supportive contact with the outer wall of the inner container. The base of the outer container has fork-lift tine pockets. There is a means for filling the inner container, and a means for emptying the inner container, both means being accessible from the outer container exterior.

7 Claims, 4 Drawing Sheets

STACKABLE BULK TRANSPORT CONTAINER

This is a continuation-in-part of application Ser. No. 08/110534 filed Aug. 24, 1993, now abandoned.

BACKGROUND OF THE INVENTION

1. Field of the Invention

The present invention relates to an improved stackable transport container, and in particular to an intermediate-bulk stackable re-useable composite container which meets the United Nations Standard Chapter 16 Packing Group II Standards for Composite Intermediate-Bulk Transport Containers.

Containers in this category are designed for the transport of liquids which may be toxic and/or corrosive and/or oxidisers (i.e. Class 5 and Class 8 liquids). Such containers must be corrosion-resistant, and must also be very strong, since typically each container will hold 1000 liters of liquid having a specific gravity of up to 1.8.

For economical use, the containers must be easy to handle, and for economical transport and storage, the containers must be stackable.

Containers of this type usually are required by users to be stackable 2- high.

2. Description of the Prior Art

To meet the criteria outlined above, a container must be corrosion-resistant and have the strength to withstand not only the pressures of the liquid contained in the container, but also the pressures imposed on the container when it is handled and stacked.

For commercial reasons, the containers must also be such that they can be made at an acceptable price, and have an acceptably long working life typically in excess of five years. United Nations regulations require that such containers are tested every five years.

To achieve the necessary corrosion-resistance, the best materials to use are stainless steel or a suitable known corrosion-resistant plastics material such as polyethylene or polyvinyl chloride, However, stainless steel is expensive as a material and also is expensive to fabricate. Plastics materials are less expensive and can be fabricated using cheaper methods (e.g. moulding) but hitherto have been unable to achieve the necessary strength without excessive wall thickness. If very thick walls are used, the cost of materials increases and the container itself is disproportionately bulky compared to the amount of liquid it contains.

It will be appreciated that any of a large range of materials and designs can be used for a suitable container if commercial considerations are ignored, but the requirements of an acceptable price and of achieving the necessary strength without excessive wall thickness impose difficult design and material criteria.

The shape of the container further increases the difficulties of design: it is well known that, for a given wall thickness, a circular cross-section container is very much stronger than any cross-sectional shape which has corners or bends, because no matter what the method of fabrication, bends or corners inevitably introduce areas of greater stress in the container walls at and adjacent the bends or corners. These stressed areas are weaker under load, so to compensate for this weakness, the overall thickness of the wall structure must be increased. This increases the bulk of the container, and its cost of manufacture.

Thus, a container having a cross-section which is square, rectangular, octangular, hexagonal or other readily-stackable shape, requires a very much greater wall-thickness than a container of circular cross-section, where no areas of raised stress occur, and the loading on the wall imposed by the fluid in the container is evenly distributed around the wall of the container. Thus, a circular-cross-section container is comparatively economical in materials. However, circular cross-section containers are awkward to handle and cannot be stacked to form a 'solid' load i.e. with adjacent containers touching each other on all sides.

A number of different solutions to the above-described problems have been proposed in the prior art. For example, U.S. Pat. No. 5,156,268 (Nichols) discloses a rigid metal outer container of rectangular cross-section lined with a thin wall plastics inner tank, the walls of which are supported by the outer container. The rectangular cross-section gives good handling and stacking characteristics to the container, and the inner plastics container is corrosion-resistant so that the container can be used for corrosive liquids. The use of a metal outer container means that the container is of adequate strength to withstand both handling and stacking stresses and the stress of the contained liquid. However, the construction is far from ideal, since it is expensive to manufacture, and the metal outer container is susceptible to corrosion damage from spills from the inner liner.

U.S. Pat. No. 4,982,867 (Dubois) discloses a two part drum-like container in which the inner container is made of plastics material and the outer container is made of a corrugated fibre material. Both inner and outer containers are square in cross-section, but the sides of the square are slightly rounded and the corners are rounded; this is said to improve the structural strength of the container. The inner container is provided with one or more filling/emptying apertures in its upper surface but these apertures are non-accessible from the exterior of the container: the outer container fits over the inner container as a shell, and at least the top of the outer container must be removed for access to the inner container.

This container essentially is a compromise between a rectangular cross-section container for goods stacking and handling characteristics and a cylindrical container for strength. Unfortunately, like many compromises, the container essentially has the drawbacks of both types:- it is lower in strength than a cylindrical container, but is not as readily stackable or as easy to handle as a square or rectangular cross-section container because of the curvature of the sides. A further drawback is the lack of filling/emptying access without partly dismantling the container.

U.S. Pat. No. 4,595,112 (Dubois) relates to an insulated container in three parts: an inner liner, an insulating shell and a fibre drum. All three components are circular in cross-section and the container is essentially designed as an insulating container rather than for ease of transport.

U.S. Pat. No. 3,406,855 (McKechnie) discloses a two-part container which consists of a stainless steel inner tank generally rectangular in shape, with a fibre-glass reinforced plastic outer casing. The loss of strength due to the rectangular shape of the inner tank is compensated for by the fact that the inner tank is of stainless steel, but this has the drawback (discussed above) of greatly increased cost.

U.S. Pat. No. 5,259,509 (Boal) discloses a stackable storage container which has a pallet base carrying a cylindrical tank. The tank itself is a single skin construction and is separate from the pallet base. This design has the advantages of strength from the cylindrical shape of the tank, and the top of the tank is designed to cooperate with the pallet base so that the tanks can be stacked. However, this construction nevertheless has the drawback of being an awkward shape to handle and stack, and is also a very expensive type of construction.

French Patent No. 2134729 relates to plastics packaging for glass bottles, and discloses a two part protective shell for a glass or other fragile bottle. The lower half of the shell is provided with a hollow in which the glass bottle nests, the top half of the shell is a press or a screw fit over the bottom half of the outer shell. Both the bottle and the protective shell are of circular cross-section. The shell is simply a protective case for transport and is not permanently secured to the inner container in any way. Further, the outer shape of the completed unit is of circular cross-section, and therefore is difficult to handle or stack.

U.S. Pat. No. 5,232,120 (Dunken) discloses a single skin vessel which is circular in cross-section and frustro-conical in shape. The container may be moulded with an integral pallet base, or mounted on a pallet or seated in a protective tub which protects the base of the container and has the same outer shape as the base of the container. Thus, a container has the strength which results from a circular cross-section container, but is an inconvenient shape for handling or stacking.

U.S. Pat. No. 5,024,346 (Roser) discloses a storage and transport container which consists of a rectangular cross-section framework of metal bars which form an outer cage containing a flexible inner liner having the same general shape as the outer cage. The inner liner has no strength of its own:- all the load of the contained fluent material is taken by the outer cage.

U.S. Pat. No. 4,286,723 (Schutz) discloses a circular cross-section steel barrel with a blow moulded inner plastics liner, also of circular cross-section. The liner is non-load bearing and functions purely as a liner. The composite container is generally cylindrical in shape, and therefore is not easy to either handle or stack.

U.S. Pat. No. 3,782,602 (Page) discloses a single skin container of generally rectangular cross-section but with a slightly tapered shape so that the containers may be stacked one upon the other, for holding frozen or melted water or other liquid for domestic purposes. The container is not designed for commercial scale transport of toxic or corrosive liquids and is a single skin structure only.

U.S. Pat. No. 4,421,243 (Croley) discloses a fibre board disposable container which is supported upon a square pallet and holds a flexible bag liner which is non-load bearing. The container is generally cylindrical in shape and although the pallets base makes the containers stackable, the composite container/pallet never-the-less is an awkward shape for handling or stacking and occupies excessive space when stacked because of the overhanging pallet base.

It is an object of the present invention, to provide an intermediate bulk stackable composite container which overcomes the drawbacks of the prior art and provides a robust low cost composite container which has good handling and stacking characteristics but which can be manufactured relatively inexpensively from plastics material.

The use of a corrosion-resistant plastics material for such a container clearly is advantageous but hitherto the use of an all-plastics construction has been restricted by strength considerations:- a rectangular cross-section plastics container is simply not strong enough to withstand both the pressure of the contained liquid and the stacking pressures, without using an excessive wall thickness and making the container difficult to manufacture and uneconomic to use, and a cylindrical container, whilst strong enough to withstand the pressures upon it, is an inconvenient shape to stack and to handle.

BRIEF SUMMARY OF THE INVENTION

The present invention overcomes these problems by providing a stackable intermediate-bulk transport composite container comprising: a cylindrical inner container made of corrosion-resistant plastics material, said inner container having walls of a thickness capable of fully supporting the pressures of any contained liquid, an outer container enclosing the inner container, said outer container being made of corrosion-resistant plastics material and being of rectangular cross-section, said outer container being of a strength adequate for withstanding stacking pressures but inadequate for withstanding the pressures of the contained liquid in the absence of the inner container, the outer container being provided with a plurality of spaced inwardly projecting ribs in supportive contact with the outer wall of the inner container, the base of the outer container being provided with fork-lift fine pockets; means for filling the inner container, and means for emptying the inner container, both filling and emptying means being accessible from the exterior of the outer container.

Preferably said corrosion-resistant plastics material is transparent or translucent.

The total load on the composite container in use is made up of a number of factors: the pressure of the liquid contained in the container, loads imposed on the container when it is being handled, and the weight of another similar container when the containers are stacked two high.

The use of the two part construction of the present invention i.e. an inner cylindrical container which bears the load of the contained liquid and an outer rectangular container which bears the stacking pressures, means that the total load on the container is shared in such a way that the inner and outer containers do not need to be designed to bear the total load on their own, and the composite container is safe in use and economical to manufacture.

BRIEF DESCRIPTION OF THE DRAWINGS

By way of example only, a preferred embodiment of the present invention is described in detail with reference to the drawings accompanying the specification, in which.

DETAILED DESCRIPTION OF THE PREFERRED EMBODIMENTS

Figure 1:
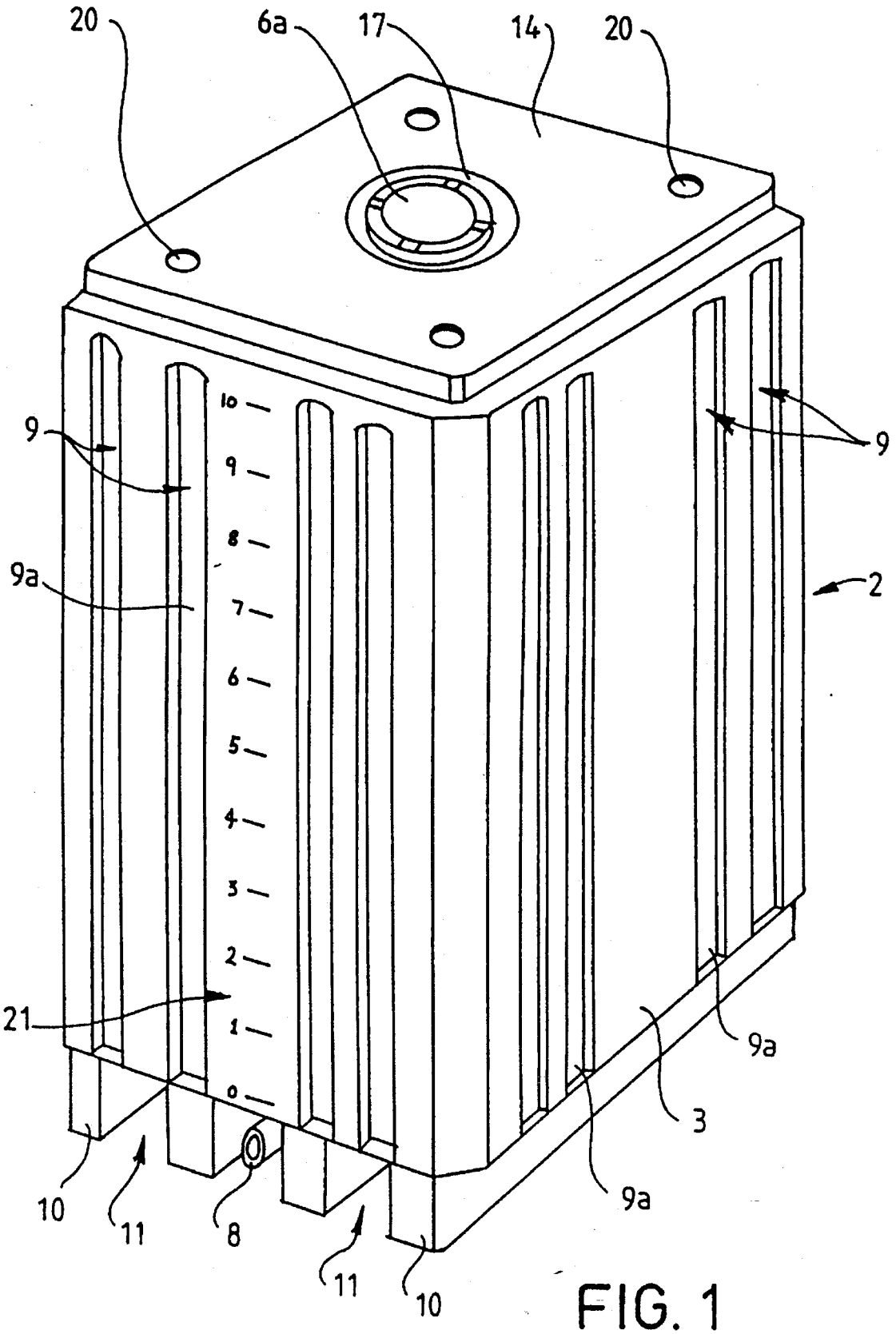
FIG. 1 is an isometric side view of the complete composite container in accordance with the present invention.

Referring to the drawings, a bull container 2 comprises an outer container 3 and an inner container 4, both made of a corrosion-resistant translucent plastics material such as polyethylene or polyvinyl chloride. Both inner and outer container preferably are formed by moulding.

The inner container 4 comprises a smooth-surfaced cylinder closed at its lower end 5 and formed with an externally screw-threaded filling aperture 6 at the centre of its upper end. The cylinder wall thickness is such that the inner container can fully support the pressures of the contained liquid when the container is full, (Arrow A in FIGS. 2 and 3) without requiring support from the outer container.

In the centre of the lower end 5, a sump 7 is formed, in which a drain valve 8 (of known type) is fitted. The inner container 4 is filled through the aperture 6 and emptied through the drain valve 8.

The outer container 3 is of generally square cross-section externally but each side face is ribbed with two sets of spaced ribs 9; each rib 9 projects inwardly into the container 3. The wall thickness of the outer container is such that it can withstand all handling and stacking pressures (Arrows B in FIG. 2) when the containers are stacked 2-high.

Figure 3:
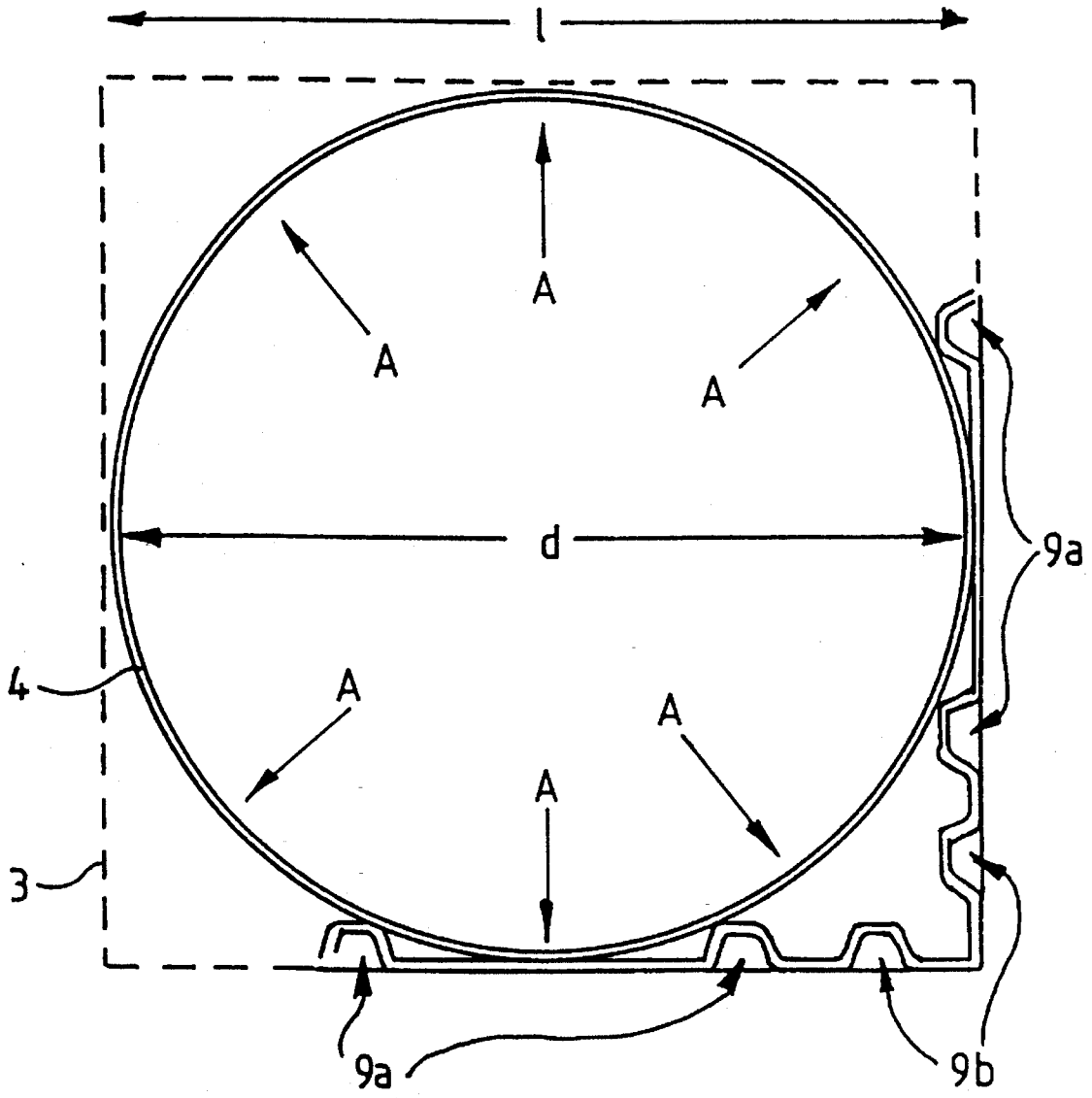
FIG. 3 is a sectional view through the diameter of the inner cylindrical container, showing its relationship with the outer container.

The outer container is dimensioned so that the length L of each side of the outer container is slightly greater than the diameter D of the inner container, and the inner container is a sliding fit within the outer container. As shown in FIG. 3 the ribs 9 along each side of the outer container project inwards, and on each side of the outer container, the ribs **9*a* located nearest the centre of that side project inwards sufficiently to contact the outer surface of the inner container, and act as a locating rib, to hold the inner container 4 in position centrally within the outer container. If extra stabilizing of the inner container is required, the other ribs 9*b*** on each side can be made deeper so that they too contact the inner container.

The underside of the outer container is formed with protrusions 10, the bases of which form wide, spaced ledges on which the container rests. The spaces 11 between adjacent protrusions 10 form pockets for fork line access. The width of the protrusions 10 and the size of the spaces 11 may be varied as required for particular applications.

Internally, the base of the inner container 4 is shown as resting on a plate 12 located over the top of the protrusions 10, so that the base of the inner container is evenly supported. However, if the number and/or spacing of the spaces 11 is altered so as to increase the width of the kipper stirface of each space 11, said surfaces may provide adequate support for the inner container, and the plate 12 can be omitted.

The sump 7 fits inside a central protrusion 13 in the outer container, and this helps to locate the inner container within the outer.

The top of the outer container 3 is closed by a lid 14 which has a central aperture through which the filling aperture 6 projects; the filling aperture is closed by a removable screw-threaded cap **6*a***.

Figure 2:
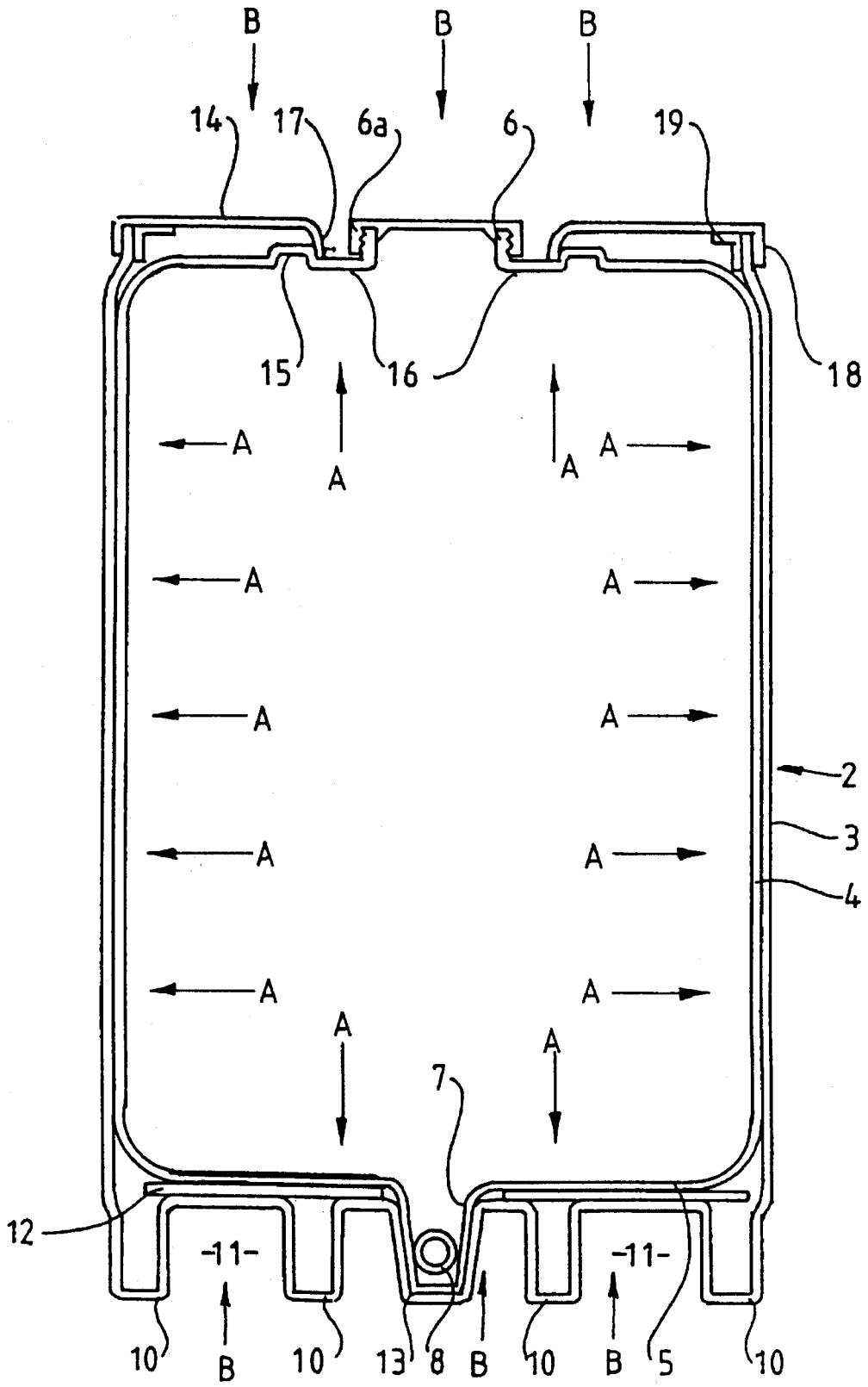
FIG. 2 is a longitudinal sectional view through the container of FIG. 1, showing the inner container disposed within the outer container.

As shown in FIG. 2 the upper end of the inner container is formed with a circular rib 15 surrounding, but spaced a short distance from, the aperture 6; the projecting sides of the aperture 6 and the rib 15 form the sides of a trough 16, which catches any spills when the inner container is filled. A drain whole (not shown) is formed through the side of the trough 16 into the space between the inner and outer containers.

The lid 14 is formed with a circular shoulder 17 which locates against the side of the rib 15, leaving the trough 16 open.

The outer edge of the lid 14 is formed with a lip 18 which overlaps the upper edge of the outer container. A metal angle 19 is located with one face against the inner surface of the upper edge of the outer container, and the other face against the lower surface of the lid, as reinforcement. The lid is secured in place by screws (not shown) which extend through the overlapping parts of the lid and the outer container and through the metal angle 19.

The lid 13 is formed with four spaced lashing hook pockets 20, and may also be formed with protruding locating cleats (not shown) for locating the containers when stacked; corresponding recesses (not shown) are formed in the base of the outer container.

The cleats may be formed with indentations so that lashing ropes can be positively located over the top of the container.

The container may also be provided with one or more pressure-relief valves or anti-vacuum valves (not shown).

If the inner and outer containers are made of a translucent or transparent plastics, preferably one side of the outer container carries a gauge 21, so that a user can see at a glance approximately how much liquid remains in the inner container.

The only metal used in the container is in the angle 19 and the screws.

Figure 4:
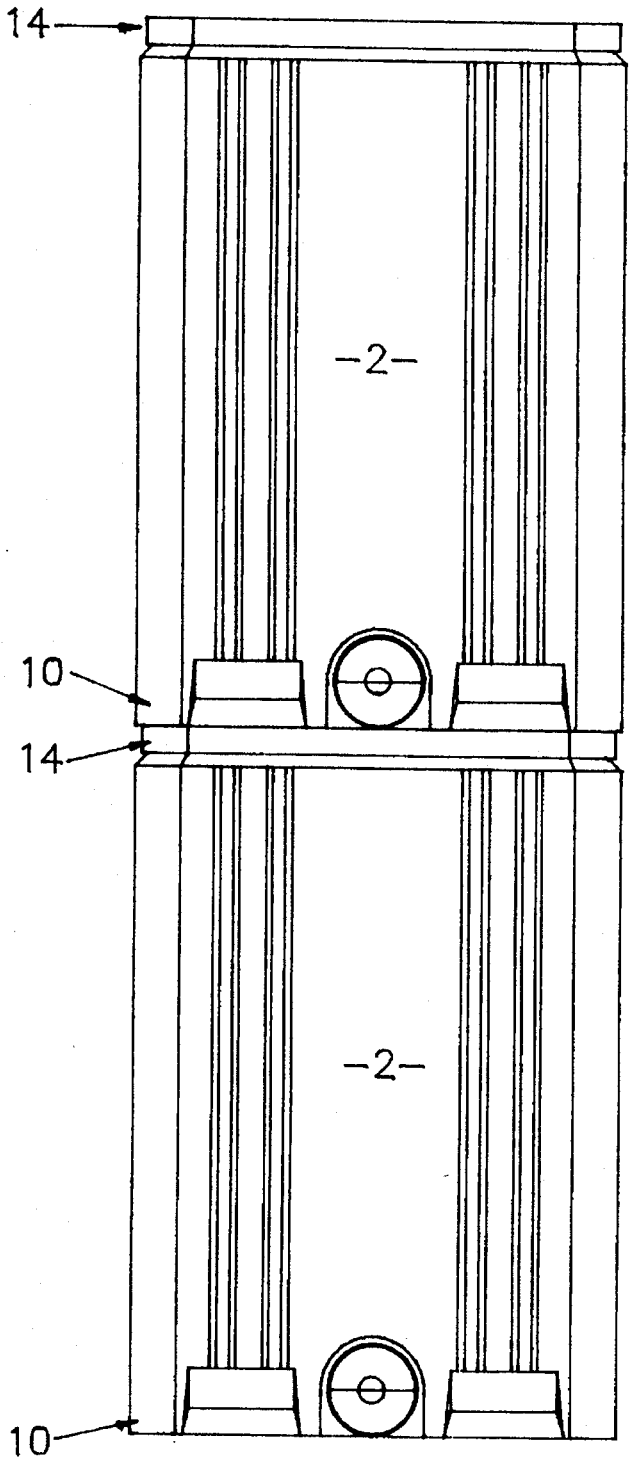
FIG. 4 is a diagrammatic side view showing the containers of FIG. 1 stacked two high.

The above-described container may be manufactured from moulded components, and is relatively quick and easy to assemble, and to fill and empty. The container is easily handled and stacked. FIG. 4 shows one container stacked upon another, with the protrusions on the upper container rests upon the lid 14 of the lower container.

In a typical container as described above, the inner container has a wall thickness of approximately 8–10 mm and is made of low-density polyethylene. The inner container must meet United Nations pressure vessel test criteria and is tested to a pressure of 100 kpa.

The outer container has a wall thickness of approximately 8–10 mm and is made of high-density polyethylene. The composite container is certified for 2- high stacking by Lloyds.

I claim:

1. A stackable re-usable intermediate-bulk transport composite container which includes an inner and an outer container, the base of the outer container being provided with fork-lift tine pockets and further includes means for filling and means for emptying the inner container, characterized in that the inner container is cylindrical in shape and is made of corrosion-resistant plastics material, said inner container having walls of a thickness capable of fully supporting the pressures of any contained liquid; the outer container encloses the inner container, said outer container being made of corrosion resistant plastics material and being of rectangular cross-section, said outer container being of a strength adequate for withstanding stacking pressures but inadequate for withstanding the pressures of the contained liquid in the absence of the inner container, the outer container being provided with a plurality of spaced inwardly projecting ribs in supportive contact with the outer wall of the inner container; and both filling and emptying means are accessible from the exterior of the outer container.

2. The container as claimed in claim 1 wherein the top of said outer container is closed by a removable lid formed with an aperture through which said filling means projects.

3. The containers as claimed in claim 1 wherein the top of the inner container is formed with a trough surrounding said filling means, to collect any spills.

4. The container as claimed in claim 3 wherein said trough is formed with a drain hole for draining any spills into the space between the inner and outer containers.

5. The container as claimed in claim 1 wherein the inner container is made of low-density polyethylene and the outer container is made of high-density polyethylene.

6. The container as claimed in claim 2 wherein the outer container is of generally square cross-section.

7. The container as claimed in claim 2 or claim 3 wherein said filling means comprises a closable aperture formed in the top of the inner container; and said emptying means comprises a sump fitted with a drain valve which projects through the outer container.

* * * * *